US005395437A

United States Patent [19]

Chiou

[11] Patent Number: 5,395,437

[45] Date of Patent: Mar. 7, 1995

[54] COMPOSITION OF A CERAMIC MOLD AND ITS STRUCTURE

[76] Inventor: Wen-Liang Chiou, No. 10, Lane 137, Chung Cheng 1 Rd., Ying Ko Chen, Taipei Hsien, Taiwan, Prov. of China

[21] Appl. No.: 201,331

[22] Filed: Feb. 24, 1994

[51] Int. Cl.[6] ..... B28B 7/36

[52] U.S. Cl. ..... 106/38.2; 106/38.9; 264/337

[58] Field of Search ..... 106/38.2, 30.27, 38.9; 264/337

[56] References Cited

U.S. PATENT DOCUMENTS 4,938,802 7/1990 Noll et al. ..... 106/38.9

5,310,420 5/1994 Watts ..... 106/38.9

*Primary Examiner*—Mark L. Bell

*Assistant Examiner*—Paul Marcantoni

*Attorney, Agent, or Firm*—Bacon & Thomas

[57] ABSTRACT

A ceramic mold made up of $Al_2O_3$, a silicon oxide mixture, C.M.C., $CaCO_3$, $Fe_2O_3$ or CoO, and water through a forging process under temperature within 500° C. to 1600° C., having a net of permeation holes on the inside and a guide tube disposed on the outside for drawing water from said net of permeation holes out of the ceramic mold or driving air into said net of permeation holes.

10 Claims, 1 Drawing Sheet

COMPOSITION OF A CERAMIC MOLD AND ITS STRUCTURE

BACKGROUND OF THE INVENTION (a) Field of the Invention

The present invention relates to the composition of a ceramic mold and its structure. The ceramic mold is made up of $Al_2O_3$, a silicon oxide mixture, C.M.C., (carboxymethylcellulose) $CaCO_3$, $Fe_2O_3$ or CoO, and water through a forging process, having a net of permeation holes on the inside for drawing off water quickly during the molding of a blank.

(b) Description of the Prior Art

Conventionally, plaster molds are commonly used for molding ceramic products. However, plaster molds are not durable in use and may be broken easily during transportation. Therefore, much cost will be spent on the purchase of plaster molds. Regular plaster molds have good water absorptive ability. However, when a plaster mold is used for molding ceramic blanks, it must be dried properly after the absorption of a certain amount of water. The drying process of the plaster mold complicates the production of the ceramics. Furthermore, in addition to conventional molding process by filling clay wash into the plaster mold for molding a blank, a mechanical punching apparatus may be used to punch wet clay into the desired shape. However, a plaster mold will be damaged quickly when it is mounted on a mechanical punching apparatus to punch wet clay into blanks.

SUMMARY OF THE INVENTION

The present invention has been accomplished to provide a ceramic mold which eliminates the aforesaid drawbacks. According to one aspect of the present invention, the ceramic mold is made up of $Al_2O_3$, a silicon oxide mixture, C.M.C., $CaCO_3$, $Fe_2O_3$ or CoO, and water through a forging process. Because the melting point of aluminum oxide is much higher than the silicon oxide mixture, aluminum oxide is still maintained not melted when the silicon oxide mixture is melted, and therefore the particles of aluminum oxide are combined into the melted mixture evenly causing fine gaps occurred in the forged mold evenly. The strength of the ceramic mold is high, and therefore the ceramic mold is suitable for molding blanks efficiently through a punching process. The molded blanks thus obtained contain less water and do not deform easily. Therefore, the ceramic mold is suitable for molding blanks either by filling or punching process.

According to another aspect of the present invention, the ceramic mold has a net of permeation holes on the inside and a guide tube disposed on the outside for drawing water from the net of permeation holes out of the ceramic mold, as well as for driving air of wind pressure about 0.5 to 1 kg/cm2 into the net of permeation holes for quick stripping of the ceramic mold from the blank being molded.

DETAILED DESCRIPTION OF THE PREFERRED EMBODIMENT

The composition of a ceramic mold made according to the present invention includes in weight percent:

| | |
|---|---|
| $Al_2O_3$ | 33.3 to 34% |
| Mixture | 20.1 to 21.4% |
| C.M.C. | 4.9 to 5.8% |
| $CaCO_3$ | 0.4 to 0.5% |
| $Fe_2O_3$ or CoO | 0.25 to 0.35% |
| WAter | 38 to 40% |

in which, the mixture comprises:

| | |
|---|---|
| $SiO_2$ | 66.2 to 67% |
| $Al_2O_3$ | 21.3 to 22.5% |
| $Fe_2O_3$ | 0.5 to 0.5% |
| $TiO_2$ | 0.1 to 0.2% |
| CaO | 0.5 to 0.6% |
| MgO | 0.1 to 0.2% |
| $K_2O$ | 2 to 3% |
| $Na_2O_3$ | 1.5 to 2.5% |
| Igloss | 5 to 6%; |

the size of $Al_2O_3$ is within 600 to 1200 mesh.

The aforesaid composition is forged into shape under temperature within 500° C. to 1600° C. permitting the mixture to be combined with aluminum oxide. Because the melting point of aluminum oxide is much higher than the mixture, aluminum oxide is still maintained not melted when the mixture is melted, and therefore the particles of aluminum oxide are combined into the melted mixture evenly causing fine gaps occurred in the forged mold evenly. The strength of the ceramic mold is about 39000 times over a conventional plaster mold or 3900 times over a conventional porous resin mold. Because the ceramic mold was forged under temperature within 500° C. to 1600° C., it is much stronger than conventional resin molding molds against heat. Therefore, the ceramic mold is much durable in use. Following shows a test result made on porous, air (water) permeable ceramic molds of the present invention and prior art plaster molds.

| SAMPLE | BULK DENSITY | APPARENT DENSITY | MOHS HARDNESS |
|---|---|---|---|
| PLASTER MOLD OF THE PRIOR ART | 0.883 | 3.226 | 1.5° |
| CERAMIC MOLD OF THE INVENTION | 2.158 | 3.392 | 5.5° |

The ceramic mold of the present invention provides high compressive strength and does not deform easily. Therefore, it is suitable for use in ceramic industry for molding models through an automatic punching process to greatly improve the production capacity.

Figure 1:
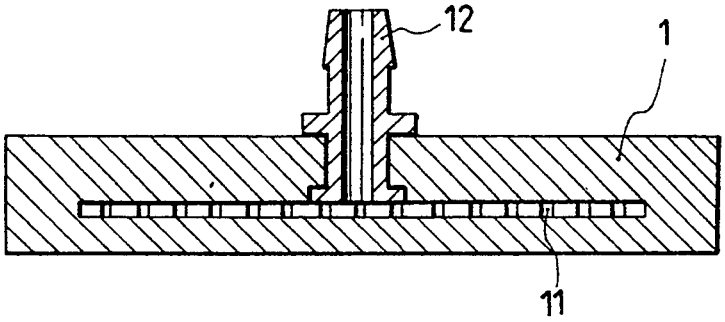
FIG. 1 is a longitudinal section of a ceramic mold made according to the present invention.
Figure 2:
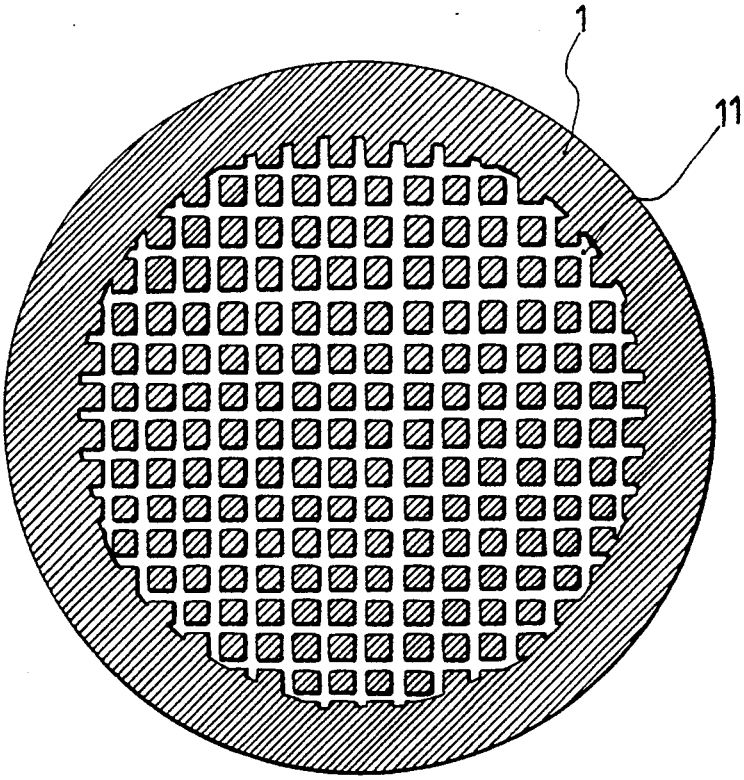
FIG. 2 is a transverse section of the ceramic mold shown in FIG. 1.

Referring to FIGS. 1 and 2, a ceramic mold of the present invention, referenced by 1, has a net of permeation holes 11 on the inside and connected to the outside by a guide tube 12. When molding a blank, water is collected through the net of permeation holes 11 and then drawn away from the ceramic mold 1 through the guide tube 12. Air can also be driven into the ceramic mold 1 through the guide tube 12 before removing the ceramic mold from the blank. Because the ceramic mold 1 is air (water) permeable, water can be quickly drawn away, and therefore it is not necessary to heat dry the ceramic mold 1.

The aforesaid net of permeation holes 11 is made by fastening a net of melting material inside the ceramic mold before the ceramic mold is made. When the ceramic mold is made, the net of melting material was melted and disappeared, and therefore the net of permeation holes 11 is formed.

As indicated, the ceramic mold has a net of permeation holes for letting water be drawn away quickly upon the molding of a blank, and therefore the blank contains less water and does not deform easily. A current of air at pressure 0.5 to 1 kg per cm2 can be driven into the ceramic mold and distributed through the net of permeation holes for permitting the blank to be quickly removed from the ceramic mold. As the ceramic mold is made through a high temperature forging process, it provides satisfactory wear-proof and heat-proof properties. Therefore, the ceramic mold is suitable for a 24-hour full run production.

I claim:

1. A composition for use in preparing an air and water permeable ceramic mold, which comprises particulate $Al_2O_3$, a silicon oxide mixture, carboxymethylcellulose (C.M.C.), $CaCO_3$, water and $Fe_2O_3$ or CoO.

2. The composition of claim 1 wherein all the components are mixed in proportion as (weight percent):

| | |
|---|---|
| $Al_2O_3$ | 33.3 to 34% |
| silicon oxide mixture | 20.1 to 21.4% |
| C.M.C. | 4.9 to 5.8% |
| $CaCO_3$ | 0.4 to 0.5% |
| $Fe_2O_3$ or CoO | 0.25 to 0.35% |
| Water | 38 to 40%. |

3. The composition of claim 2 wherein said silicon oxide mixture comprises, in weight percent:

| | |
|---|---|
| $SiO_2$ | 66.2 to 67% |
| $Al_2O_3$ | 21.3 to 22.5% |
| $Fe_2O_3$ | 0.5 to 0.5% |
| $TiO_2$ | 0.1 to 0.2% |
| CaO | 0.5 to 0.6% |
| MgO | 0.1 to 0.2% |
| $K_2O$ | 2 to 3% |
| $Na_2O_3$ | 1.5 to 2.5% |
| Igloss | 5 to 6%. |

4. The composition of claim 1 wherein the particle size of $Al_2O_3$ is within 600 to 1200 mesh.

5. An air and water permeable ceramic mold prepared by forging a composition comprising particulate $Al_2O_3$, a silicon oxide mixture, carboxymethylcellulose (C.M.C.), $CaCO_3$, water and $Fe_2O_3$ or CoO at a temperature of 500° C. to 1600° C.

6. The ceramic mold according to claim 5 wherein the components of the composition are present in the following proportions, by weight percent:

| | |
|---|---|
| $Al_2O_3$ | 33.3 to 34% |
| silicon oxide mixture | 20.1 to 21.4% |
| C.M.C. | 4.9 to 5.8% |
| $CaCO_3$ | 0.4 to 0.5% |
| $Fe_2O_3$ or CoO | 0.25 to 0.35% |
| Water | 38 to 40%. |

7. The ceramic mold according to claim 6 wherein the particle size of $Al_2O_3$ is 600 to 1200 mesh.

8. The ceramic mold according to claim 5 further comprising an interior net of permeation holes and an exterior guide tube through which water is withdrawn or air is injected.

9. A process for preparing an air and water permeable ceramic mold which comprises forging a mixture as claimed in claim 3 and particulate $Al_2O_3$ into shape at a temperature of 500° C. to 1600° C. in the presence of water, C.M.C., $CaCO_3$ and $Fe_2O_3$ or CoO.

10. A process according to claim 9 wherein the particle size of the $Al_2O_3$ is 600 to 1200 mesh.

* * * * *